US005603124A

United States Patent [19]

Garofalo

[11] Patent Number: 5,603,124

[45] Date of Patent: Feb. 18, 1997

[54] MODULAR DIVING MASK

[75] Inventor: Giovanni Garofalo, Rapallo, Italy

[73] Assignee: HTM Sport S.p,A., Italy

[21] Appl. No.: 524,460

[22] Filed: Sep. 7, 1995

[30] Foreign Application Priority Data

Sep. 14, 1994 [IT] Italy ..... GE94A0102

[51] Int. Cl.[6] ..... A61F 9/02

[52] U.S. Cl. ..... 2/428; 2/441

[58] Field of Search ..... 2/428, 430, 441, 2/443, 439, 440

[56] References Cited

U.S. PATENT DOCUMENTS

| | | | |
|---|---|---|---|
| 2,737,659 | 3/1956 | Glidden | 2/428 |
| 2,996,722 | 8/1961 | Jacobs . | |
| 3,323,135 | 6/1967 | Miller | 2/428 X |
| 4,828,355 | 5/1989 | Lipson et al. . | |
| 4,878,749 | 11/1989 | McGee . | |

FOREIGN PATENT DOCUMENTS

| | | | |
|---|---|---|---|
| 2384511 | 10/1978 | France | 2/428 |
| 1108470 | 6/1961 | Germany . | |
| 8605001 | 8/1986 | WIPO . | |

*Primary Examiner*—Peter Nerbun
*Attorney, Agent, or Firm*—Larson and Taylor

[57] ABSTRACT

Diving mask comprising a body made of rubber or a material similar to rubber provided with a peripheral edge which extends parallel with the plane of an ocular opening or openings; at least one lens made from tempered glass or transparent plastic which is shaped to match the shape of the ocular opening or openings respectively; and a main frame provided with several spaced apart attachment teeth which hold the said lens on lenses respectively in place, pressing them elastically and leaktightly against the said peripheral edge of the body. A variously shaped and decorated outer frame may be fitted over this main frame.

12 Claims, 3 Drawing Sheets

MODULAR DIVING MASK

BACKGROUND AND SUMMARY OF THE INVENTION

The present invention relates to diving masks.

Many types of face masks, which are off various shapes and forms of construction, and use different materials assembled in various ways, are known from the prior art, as for instance evidenced by U.S. Pat. No. 2,996,722 and DE-B-1 108 470, which are with means for water- and gas-tight securing a lens to a face mask assembly.

From the prior art, as for instance evidenced by U.S. Pat. No. 4,878,749, and WO-A-86 05001 eyeglass frames are also known provided with interchangeable decorative frames.

It is the main object of the present invention to provide a diving mask which is simple to assemble and of solid construction.

A further object of the present invention is to provide a diving mask whose aesthetic characteristics may be varied at will, either by the manufacturer or by the purchaser, without modifying the basic structure of the mask itself.

The subject of the present invention is therefore a diving mask comprising a body made of rubber or a material similar to rubber provided with a monocular or binocular opening and with a peripheral edge which extends parallel with the plane of the ocular opening; at least one lens made from tempered glass or transparent plastic which is shaped to match the shape of the said ocular opening or openings respectively; and a main frame provided with several spaced apart attachment teeth which hold the said lens or lenses respectively in place, pressing them elastically and leak-tightly against the said peripheral edge of the body.

According to a further feature of the present invention, the peripheral edge of the said body is fitted with extension pieces which are perpendicular to it and extend from both its sides relative to the plane of the body and the said main frame has a peripheral groove which accomodates one of the said extension pieces on the peripheral edge of the body.

Advantageously, the said main frame comprises the means for connection of the strap which is used to hold the said mask against the diver's face.

In addition, a variously shaped and decorated outer frame may be mounted on the said main frame of the said mask thus constructed, by slotting it over the said main frame in a way which is completely independent of the mask and of its structure, this outer frame giving the mask a specific aesthetic look, and making it possible to "personalize" the said mask, given that these outer frames are interchangeable.

In a further embodiment, this outer frame comprises the means for connection of the strap which is used to hold the mask against the diver's face.

BRIEF DESCRIPTION OF THE DRAWINGS

Further advantages and features will become clear from the following description of two embodiments of the present invention, which description is given by way of a nonlimiting example and with reference to the appended drawings, in which.

DESCRIPTION OF THE PREFERRED EMBODIMENT OF THE INVENTION

Figure 1:
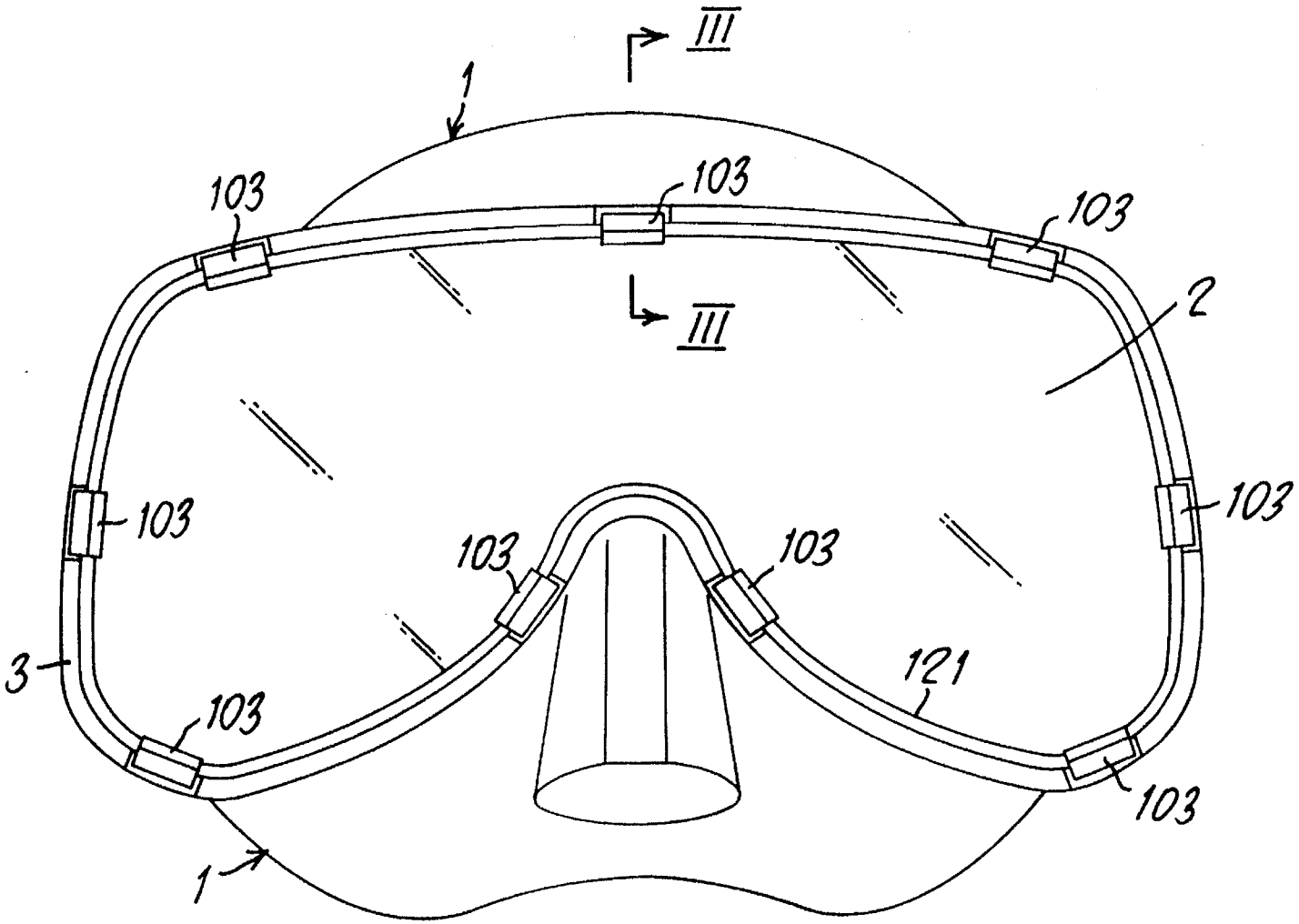
FIG. 1 is a front view of a first embodiment of the diving mask according to the invention.

In FIG. 1, the reference numeral 1 denotes the body of the mask according to the invention. This body has an ocular opening whose external edge is connected to the lens 2 by means of the main frame 3 which is fitted, for this purpose, with clamping teeth 103.

Figure 3:
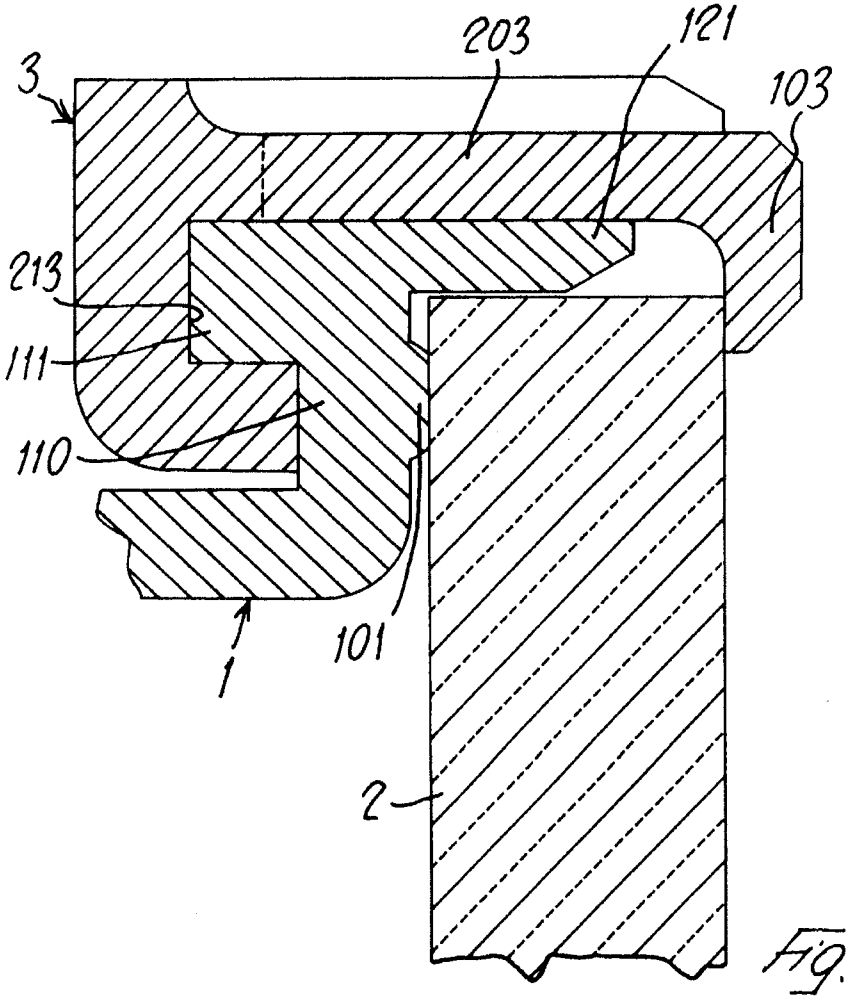
FIG. 3 is an enlarged detail in cross section along the line III—III of FIG. 1.

As is more clearly shown in FIG. 3, the main frame 3 has an outer frame in the front side of which is formed a peripheral groove 213, whose function will be described below. This main frame also has a series of elements spaced along its perimeter which hold the glass 2 in place and each consist of a shank part 203 which projects outwards and forwards and terminates at its end in a hook part 103 which is turned downwards. The body 1, which is made of an elastic material similar to rubber, of silicone rubber or the like, has an ocular opening surrounded by a peripheral edge 110 which has a peripheral protrusion 101 projecting outwards from its front side, whereas the extremity of the edge 110 of the body 1 is fitted with a pair of extension pieces 111, 121 which are perpendicular to it and extend in opposite directions. The extension piece 111 is designed to be inserted into the groove 213 of the main frame 3, whereas the extension piece 121 extends parallel with the internal side of the edge of the main frame 3 as far as the underside of the shanks 113 of the teeth 103, so as to frame the perimeter of the glass 2.

Figure 2:
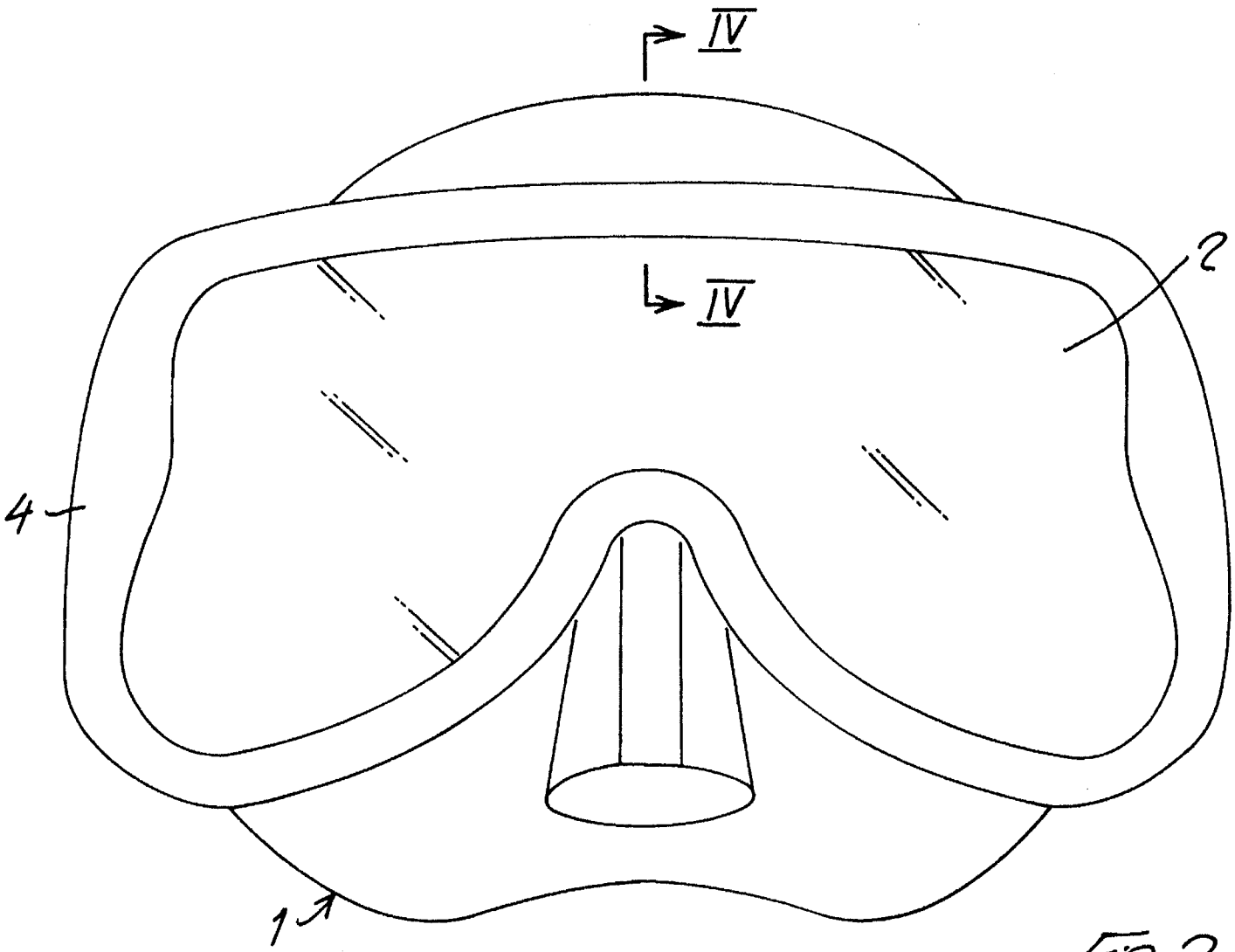
FIG. 2 is a view of a second embodiment of the mask according to the invention.
Figure 4:
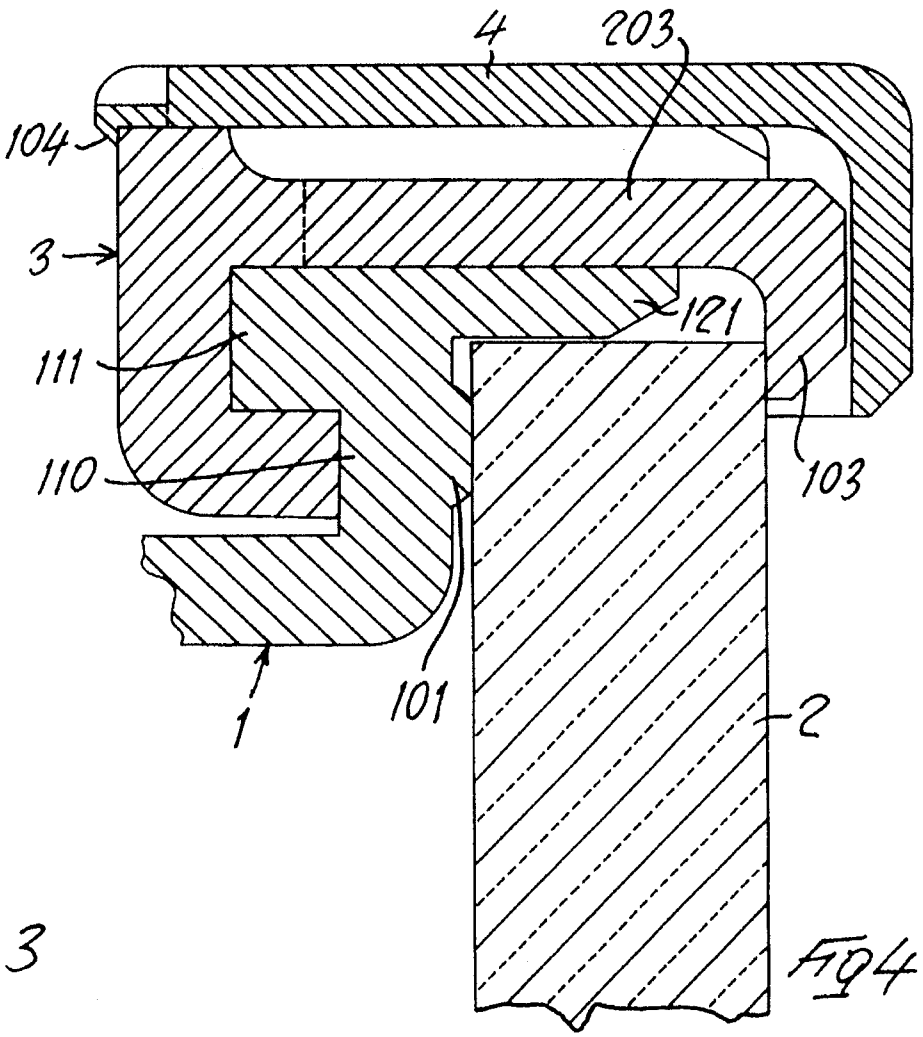
FIG. 4 is an enlarged detail in cross section along the line IV—IV of FIG. 2.

FIG. 4 shows a sectional view along the line IV—IV of FIG. 2. The glass 2, the main frame 3 and the edge 101 of the ocular opening of the body 1 are in the same position as that described above and illustrated in FIG. 1. In addition, there is an outer frame 4 (see also FIG. 2) placed over the said main frame 3 which covers it completely; this outer frame is held firmly in place by slotting a tooth-like projection 104 over the external face of the back wall of the said main frame 3.

Assembly of the mask and its operation will be evident from the following description. The extension piece 111 of the body 1 is inserted into the groove 213 of the maim frame 3. The extension piece 121 is then resting against the internal side of the side wall of the main frame 3 and against the inwardly facing side wall of the shanks 203 of the teeth 103. The glass 2 is at this point inserted into the main frame 3 by pressing it in. The teeth 103 lock the said glass 2 against the peripheral protrusion 101 on the body 1 thereby ensuring that the space inside the mask remains watertight, whereas around the sides the edge of the glass 2 is pressed against the internal side of the extension piece 121 of the edge 110 of the body 1.

The mask is completed by the strap which holds it against the diver's head, and which may be attached to the main frame 3 by suitable means (not illustrated).

As illustrated and described with reference to FIGS. 2 and 4, in the mask according to the invention it is possible to place an outer frame 4 over the main frame 3 which is connected to the main frame 3 by being slotted over it, as illustrated in FIG. 4, and is held firmly in place by means of a suitable tooth-like projection 104. This outer frame may be interchangeable with other outer frames of similar design. In practice, the diver is in this way able to change the look of the mask, without having to make any structural alterations to it.

As an option, this outer frame may be provided with means for connection of the strap (not shown).

During the description the terms "lens", "tempered glass", "glass" and "transparent plastic" were used indifferently to indicate the materials which can be used to make the "lenses" of the mask. Naturally these materials may be used indifferently, or they may be substituted by any other type of material which is suited to the purpose.

Although the mask illustrated is of the type having a single ocular glass, it goes without saying that the invention is equally well suited to manufacturing binocular masks. Naturally, in the case of masks having two ocular glasses, both the rubber body and the main frame are modified accordingly.

I claim:

1. Diving mask comprising:

a body comprising a material selected from the group consisting of rubber and rubber-like materials, the body including an ocular opening and a peripheral edge extending parallel to a plane of the ocular opening;

a lens comprising a material selected from the group consisting of tempered glass and transparent plastic, the lens being shaped to match a shape of the ocular opening, a front side of the peripheral edge of the body having a watertight protrusion projecting toward the lens of the mask; and a main frame including several spaced apart attachment teeth formed as an integral part of said frame for holding the lens in place and pressing it elastically and leaktightly against the peripheral edge of the body.

2. Diving mask comprising:

a body comprising a material selected from the group consisting of rubber and rubber-like materials, the body including an ocular opening and a peripheral edge extending parallel to a plane of the ocular opening, said peripheral edge including extension pieces extending perpendicular to both sides of the peripheral edge relative to a plane of the ocular opening;

a lens comprising a material selected from the group consisting of tempered glass and transparent plastic, the lens being shaped to match a shape of the ocular opening; and a main frame having a peripheral groove which accommodates one of the extension pieces on the peripheral edge of the body, the main frame including several spaced apart attachment teeth for holding the lens in place and pressing it elastically and leaktightly against the peripheral edge of the body.

3. Diving mask according to claim 2, wherein a front side of the peripheral edge of the body has a watertight protrusion projecting toward the lens of the mask.

4. Diving mask according to claim 2, wherein the main frame includes means for connecting a strap thereto for holding the mask against a diver's face.

5. Diving mask according to claim 2, wherein an outer frame having a different appearance than the main frame may be fitted over the main frame for giving the mask a specific aesthetic look, said outer frame being interchangeable to provide a plurality of unique mask appearances.

6. Diving mask according to claim 5, wherein the outer frame includes means for connecting a strap thereto for holding the mask against a diver's face.

7. Diving mask according to claim 2, wherein the ocular opening comprises a monocular opening.

8. Diving mask comprising:

a body comprising a material selected from the group consisting of rubber and rubber-like materials, the body including an ocular opening and a peripheral edge extending parallel to a plane of the ocular opening;

a lens comprising a material selected from the group consisting of tempered glass and transparent plastic, the lens being shaped to match a shape of the ocular opening;

a main frame including several spaced apart attachment teeth for holding the lens in place and pressing it elastically and leaktightly against the peripheral edge of the body; and an outer frame having a different appearance than the main frame and insertable over the main frame for giving the mask a specific aesthetic look, said outer frame being interchangeable to provide a plurality of unique mask appearances.

9. Diving mask according to claim 8, wherein the outer frame includes means for connecting a strap thereto for holding the mask against a diver's face.

10. Diving mask comprising:

a body comprising a material selected from the group consisting of rubber and rubber-like materials, the body including an ocular opening and a peripheral edge extending parallel to a plane of the ocular opening;

a lens comprising a material selected from the group consisting of tempered glass and transparent plastic, the lens being shaped to match a shape of the ocular opening;

a main frame including several spaced apart attachment teeth formed as an integral part of said frame for holding the lens in place and pressing it elastically and leaktightly against the peripheral edge of the body; and an outer frame having a different appearance than the main frame for fitting over the main frame and giving the mask a specific aesthetic look, said outer frame being interchangeable to provide a plurality of unique mask appearances.

11. Diving mask according to claim 10, wherein the outer frame includes means for connecting a strap thereto for holding the mask against a diver's face.

12. Diving mask according to claim 1, wherein the ocular opening comprises a monocular opening.

* * * * *